US007383690B2

(12) United States Patent
Maglinger et al.

(10) Patent No.: US 7,383,690 B2
(45) Date of Patent: Jun. 10, 2008

(54) ICE HARVEST PREVENTION MECHANISM IN A REFRIGERATOR

(75) Inventors: Frank Weston Maglinger, Evansville, IN (US); Joseph Michael Griffith, White Bluff, TN (US); Sinuhe Argumedo, Guadalupe (MX); Gregory Gene Hortin, Henderson, KY (US); Leonardo Rangel, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 349 days.

(21) Appl. No.: 11/293,984

(22) Filed: Dec. 5, 2005

(65) Prior Publication Data

US 2007/0125101 A1 Jun. 7, 2007

(51) Int. Cl.
*F25C 5/18* (2006.01)

(52) U.S. Cl. ..... 62/137; 62/344; 141/362; 222/146.6

(58) Field of Classification Search ..... 62/137, 62/344; 141/351, 360, 362; 222/146.6
See application file for complete search history.

(56) References Cited

U.S. PATENT DOCUMENTS

| | | | | |
|---|---|---|---|---|
| 2,717,500 | A | 9/1955 | Ploeger | |
| 2,955,442 | A | 10/1960 | Loewenthal | |
| 2,976,697 | A | 3/1961 | Dahl | |
| 3,055,184 | A | 9/1962 | Linstromberg | |
| 3,621,668 | A | 11/1971 | Swerbinsky | 62/137 |
| 3,885,400 | A | 5/1975 | Webb | 62/137 |
| 4,007,602 | A | 2/1977 | Maxwell et al. | 62/137 |
| 4,069,545 | A * | 1/1978 | Holet et al. | 16/49 |
| 4,100,761 | A | 7/1978 | Linstromberg | 62/137 |
| 4,872,318 | A | 10/1989 | Klemmensen | 62/137 |
| 5,119,639 | A | 6/1992 | Bein et al. | 62/137 |
| 5,437,391 | A * | 8/1995 | Landers et al. | 222/1 |
| 5,619,858 | A | 4/1997 | Gunderson et al. | 62/137 |
| 5,860,564 | A * | 1/1999 | Jablonski | 221/303 |
| 6,109,476 | A | 8/2000 | Thompson et al. | 222/1 |
| 6,135,173 | A * | 10/2000 | Lee et al. | 141/361 |
| 6,334,319 | B1 | 1/2002 | Senner | 62/137 |
| 6,745,578 | B2 | 6/2004 | Collins et al. | 62/71 |

* cited by examiner

*Primary Examiner*—William E. Tapolcai
(74) *Attorney, Agent, or Firm*—Kirk Goodwin; Michael D. Lafrenz

(57) ABSTRACT

An ice harvesting prevention mechanism, including an actuator, is provided for an ice maker. The ice maker is arranged to make, harvest and dispense ice to an ice bucket located in an ice receiving position. An ice harvesting prevention device is arranged to prevent dispensing of ice in a first position of the actuator and to permit dispensing of ice in a second position of the actuator. The ice bucket itself, or a movable button carried on the ice bucket, may engage the actuator, when the ice bucket is placed in the ice receiving position, to move the actuator from the first position to the second position. The button may be moved to an "off" position to prevent engagement with the actuator, thereby preventing dispensing of ice when the ice bucket is in the ice receiving position.

20 Claims, 3 Drawing Sheets

ICE HARVEST PREVENTION MECHANISM IN A REFRIGERATOR

BACKGROUND OF THE INVENTION

The present invention relates generally to ice makers and in particular to ice makers in refrigerators.

Ice makers are known for refrigerators in which the ice maker is arranged to make, harvest and dispense ice. An ice bucket is located in an ice receiving position relative to the ice maker to receive ice dispensed from the ice maker. An ice level detecting mechanism, such as in the form of a bail, is used to detect the level of ice in the ice bucket and when a certain height is detected, to terminate the making, harvesting or dispensing of ice from the ice maker to the ice bucket.

Such ice making mechanisms are disclosed, for example, in U.S. Pat. Nos. 2,717,500, 2,955,442, 3,055,184, 3,885,400, 5,119,639, 5,619,858, 6,334,578 and 6,745,578.

Arrangements for terminating operation of the ice maker at times when the ice bucket is displaced from the ice receiving position are disclosed in a number of patents. For example, in U.S. Pat. No. 3,621,668, a spring biased lever mounted on the rear wall of the freezer compartment space is engaged by the ice bucket to move the lever into an inactive position when the ice bucket is placed in the ice receiving position. When the ice bucket is displaced, the lever pivots to engage the ice chute, which acts as a level sensing bail, and lifts the ice chute to a position to terminate operation of the ice maker until the ice bucket is replaced and the lever is returned to the inactive position.

In U.S. Pat. No. 4,007,602, a pin carried on the ice bucket engages with a lever pivotally mounted to the refrigerator freezer compartment wall. When the ice bucket is displaced, the lever is pivoted such that a portion of the lever engages and lifts the bail arm to a position where operation of the ice maker will be terminated. The bail arm has a detent such that it will be held in that position until the ice bucket is returned to the ice receiving position and the pin re-engages the lever to pivot it back to a position releasing the bail arm to sense the level of ice in the ice bucket.

In U.S. Pat. No. 4,100,761, an ice bucket is swingingly carried on swing arms, one of which pivots into a position to lift the bail to a position to terminate operation of the ice maker when the ice bucket is moved from the ice receiving position. A return of the ice bucket to the ice receiving position will allow the bail arm to return to a sensing position.

In U.S. Pat. No. 4,872,318, a spring loaded plunger, with an upstanding arm is engaged by the ice bucket to move into an inoperative position when the ice bucket is in the ice receiving position. When the ice bucket is displaced, the arm moves to lift the bail arm and hold it in a raised position to terminate operation of the ice maker until the ice bucket is returned to the ice receiving position.

It is known in the art to provide an uppermost, locked position for the bail arm that terminates operation of the ice maker until the bail arm is released to a lowered position. Such a position is used to terminate the production of ice, such as during periods when the ice bucket is removed, or if it is desired to not have ice made, even if the ice bucket is in the ice receiving position. Generally to move the bail into the locked position, when the ice maker is a low position, such as in a bottom mount freezer compartment of a refrigerator, the user must squat or kneel in order to reach the bail to effect the necessary movement.

It would be an improvement in the art if an ice harvesting prevention mechanism were provided for a refrigerator that would not only terminate operation of the ice maker, but would also prevent the dispensing of any ice from the ice maker when the ice bucket is removed. Also, it would be an improvement in the art if there were a means for manually terminating operation of the ice maker, without having to manually access the bail.

SUMMARY OF THE INVENTION

In an embodiment of the invention, an ice harvesting prevention mechanism, including an actuator, is provided for an ice maker. The ice maker is arranged to make, harvest and dispense ice to an ice bucket located in an ice receiving position. An ice harvesting prevention device is arranged to prevent dispensing of ice in a first position of the actuator and to permit dispensing of ice in a second position of the actuator. The ice bucket itself, or a movable button carried on the ice bucket, may engage the actuator, when the ice bucket is placed in the ice receiving position, to move the actuator from the first position to the second position. The button may be moved to an "off" position to prevent engagement with the actuator, thereby preventing dispensing of ice when the ice bucket is in the ice receiving position.

In an embodiment, the present invention provides an ice harvesting prevention mechanism for a refrigerator comprising an ice maker in the refrigerator arranged to make, harvest and dispense ice. An ice bucket is located in an ice receiving position relative to the ice maker to receive ice dispensed from the ice maker. An ice retention cover is arranged to prevent dispensing of ice from the ice maker when in a first position and to permit dispensing of ice from the ice maker when in a second position. An actuator is located relative to the ice bucket and the ice retention cover such that a first portion of the actuator will be in engagement with the ice bucket when the ice bucket is located in the ice receiving position and a second portion of the actuator is able to move into engagement with the ice retention cover when the ice bucket is displaced from the ice receiving position. An actuator biasing element is arranged to bias the second portion of the actuator into blocking engagement with the ice retention cover to hold the ice retention cover in the first position when the ice bucket is displaced from the ice receiving position.

In an embodiment, the actuator biasing element comprises a spring.

In an embodiment, the actuator comprises a pivotable lever.

In an embodiment, the ice retention cover is normally oriented vertically and hangs in said first position, but is pivotable to said second position, unless otherwise blocked, when engaged by ice pieces being harvested from said ice maker.

In an embodiment, an ice harvesting prevention mechanism for a refrigerator is provided comprising an ice maker in the refrigerator arranged to make, harvest and dispense ice. An ice bucket is located in an ice receiving position relative to the ice maker to receive ice dispensed from the ice maker. A movable bail arm is provided with a portion located between the ice maker and the ice bucket, the bail arm movable between a first position and a second position. A bail arm biasing element is arranged to bias the bail arm towards the first position from the second position. The bail arm is operably connected to the ice maker such that when the bail arm is in the first position and between the first position and the second position, the ice maker is enabled to make, harvest and dispense ice, and when the bail arm is in the second position, the ice maker is disabled from at least one of making, harvesting and dispensing ice. An actuator is located relative to the ice bucket and the bail arm such that a first portion of the actuator will be in engagement with a movable actuator engagement button carried on the ice bucket when the ice bucket is located in the ice receiving position and a second portion of the actuator is able to move into engagement with the bail arm when the ice bucket is displaced from the ice receiving position. An actuator biasing element is arranged to bias the second portion of the actuator into engagement with the bail arm when the ice bucket is displaced from the ice receiving position and to move the bail arm to the second position. The movable actuator engagement button is arranged so as to engage the first portion of the actuator when the ice bucket is located in the ice receiving position and the button is in a first position, and to avoid engagement with the first portion of the actuator when the ice bucket is displaced from the ice receiving position or when the ice bucket is located in the ice receiving position and the button is in a second position. The bail arm will be moved into the second position when the ice bucket is displaced from the ice receiving position and when the button is in the second position, regardless of a location of the ice bucket.

In an embodiment, the movable actuator button is carried on a rear wall of the ice bucket.

In an embodiment, the movable actuator button is arranged to slide between the first position and said second position.

In an embodiment, the actuator comprises a pivotable lever.

In an embodiment, the bail arm biasing element comprises a spring.

In an embodiment, the actuator biasing element comprises a spring.

In an embodiment, an ice harvesting prevention mechanism for a refrigerator is provide comprising an ice maker in the refrigerator arranged to make, harvest and dispense ice. An ice bucket is located in an ice receiving position relative to the ice maker to receive ice dispensed from the ice maker. An ice height detection system is arranged to detect a height of ice in the ice bucket. The ice height detection system is operably connected to the ice maker such that when the ice height detection system does not detect any obstacles at a first location, the ice maker is enabled to make, harvest and dispense ice, and when the ice height detection system does detect an obstacle at the first location, the ice maker is disabled from at least one of making, harvesting and dispensing ice. An actuator is located relative to the ice bucket and the ice height detection system such that a first portion of the actuator will be in engagement with a movable actuator button on the ice bucket when the ice bucket is located in the ice receiving position and a second portion of the actuator is able to move into the first location and be detected by the ice height detection system when the ice bucket is displaced from the ice receiving position. The movable actuator engagement button is arranged so as to engage the first portion of the actuator when the ice bucket is located in the ice receiving position and the button is in a first position, and to avoid engagement with the first portion of the actuator when the ice bucket is displaced from the ice receiving position or when the ice bucket is located in the ice receiving position and the button is in a second position. An actuator biasing element is arranged to bias the second portion of the actuator into the first location when the ice bucket is displaced from the ice receiving position and to move the bail arm to the second position. In such an arrangement, the first portion of the actuator will be moved into the first location position when the ice bucket is displaced from the ice receiving position and when the button is in the second position, regardless of a location of the ice bucket.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention provides an ice harvesting prevention mechanism 20 for an ice maker 22 which is arranged to make, harvest and dispense ice. Particular embodiments of the invention are illustrated, however the scope of the invention is not limited to the particular embodiments illustrated. For example, the ice harvesting prevention mechanism 20 may be used with a variety of refrigerators 23, such as bottom mount, top mount or side-by-side refrigerators, or even stand alone ice makers having movable ice buckets.

Figure 1:
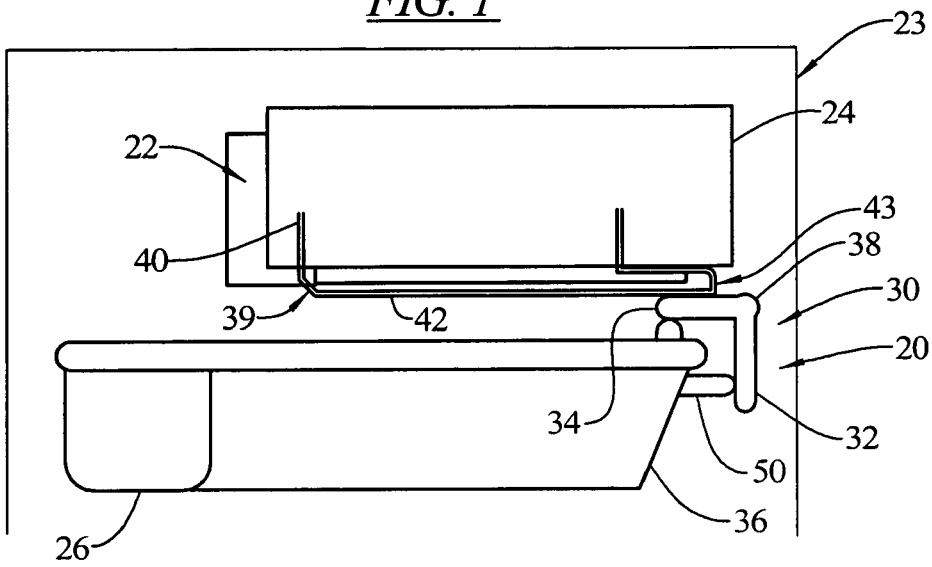
FIG. 1 is a side elevation schematic view of an ice maker and ice bucket in an ice receiving position in a refrigerator, and an ice harvest prevention mechanism embodying the principles of the present invention in a disabled position.
Figure 4:
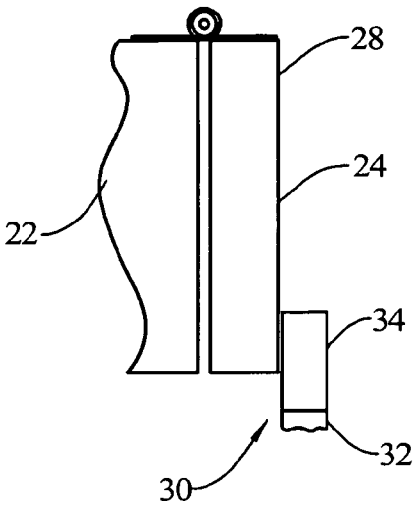
FIG. 4 is a partial side elevation view of the ice maker and ice harvest prevention mechanism of FIG. 2.
Figure 5:
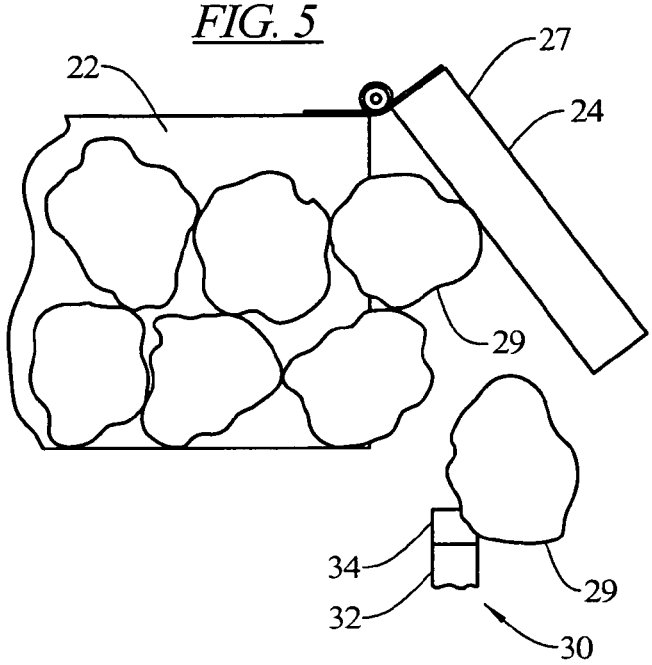
FIG. 5 is a partial side elevation view of the ice maker and ice harvest prevention mechanism of FIG. 1.

As illustrated in FIG. 1, an ice bucket 26 is located in an ice receiving position relative to the ice maker 22 to receive ice dispensed from the ice maker. The term ice bucket is meant to include any type of ice receiving receptacle arranged to receive ice from the ice maker 22. An ice retention cover 24 may be arranged to permit dispensing of ice from the ice maker when in a first position 27 (FIG. 5) and prevent dispensing of ice from the ice maker 22 when in a second position 28 (FIG. 4). In an embodiment such as illustrated in FIGS. 4 and 5, the ice retention cover 24 may be normally oriented vertically to hang in the second position 28, merely under the influence of gravity, and may be pivotably movable into the first position 27, unless otherwise blocked, when engaged by ice pieces 29 being harvested from the ice maker 22. Thus, no separate mechanisms or devices are required for maintaining or moving the ice retention cover 24 into its first 27 or second 28 positions. However, if desired, a biasing element, such as a spring, may be used to hold the ice retention cover 24 in its second position 28, so long as the falling or moving force of the harvested ice 29 is sufficient to overcome the retaining force of the biasing element to allow the ice to be dispensed from the ice maker 22 when the ice retention cover is not otherwise blocked.

Figure 2:
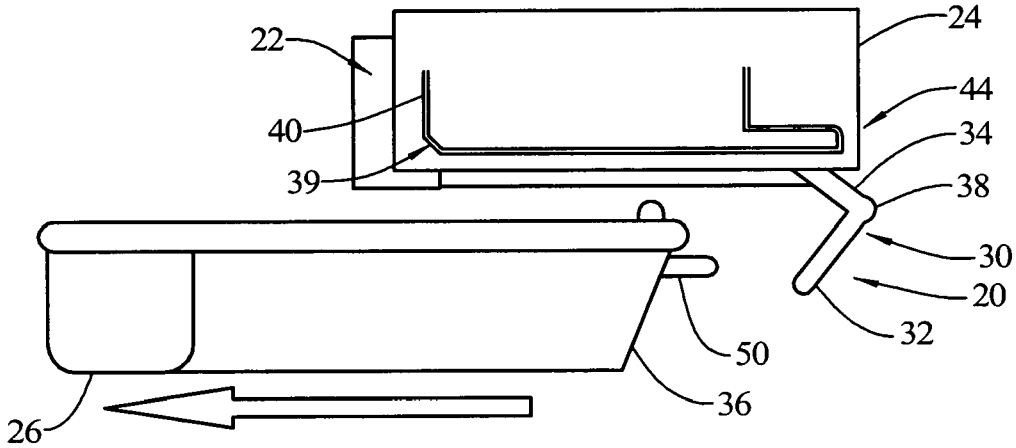
FIG. 2 is a side elevation schematic view of the arrangement of FIG. 1, with the ice bucket displaced from the ice receiving position, and the ice harvest prevention mechanism in an enabled position.

An actuator 30 is located relative to the ice bucket 26 and the ice retention cover 24 such that a first portion 32 of the actuator will be in engagement with the ice bucket when the ice bucket is located in the ice receiving position (FIG. 1) and a second portion 34 of the actuator is able to move into engagement with the ice retention cover when the ice bucket is displaced from the ice receiving position (FIG. 2).

Figure 7:
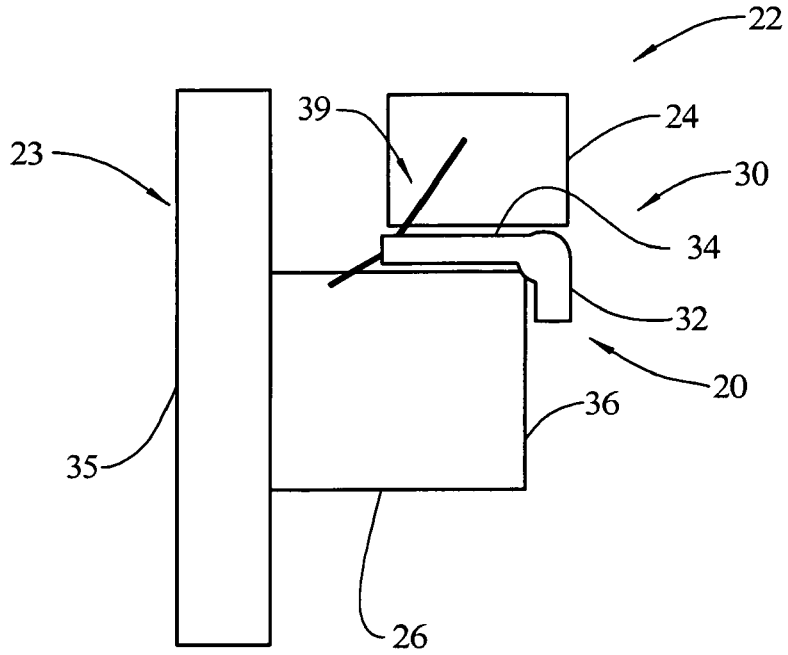
FIG. 7 is a side elevation schematic view of an ice maker and ice bucket in an ice receiving position in a side-by-side refrigerator, and an ice harvest prevention mechanism embodying the principles of the present invention in a disabled position.
Figure 8:
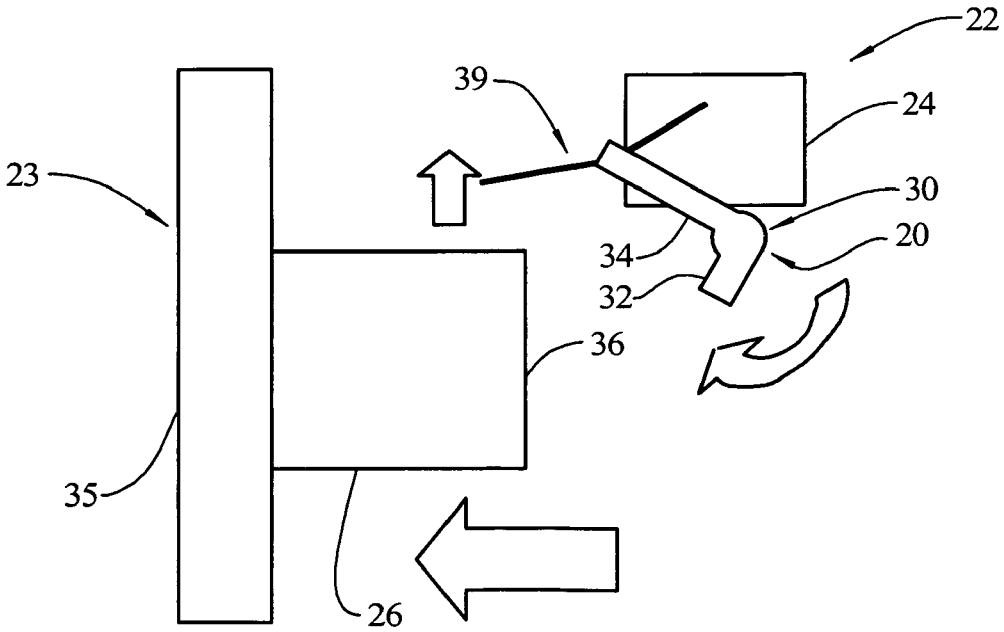
FIG. 8 is a side elevation schematic view of an ice maker and ice bucket in an ice receiving position in a side-by-side refrigerator, and an ice harvest prevention mechanism embodying the principles of the present invention in a disabled position.

The ice bucket 26 may be movable into and out of the ice receiving position upon selective grasping and moving of the ice bucket by a user, such as in top mounted or bottom mounted refrigerators, or some side-by-side refrigerators, or, as illustrated in FIGS. 7 and 8, in those side-by-side refrigerators, or other refrigerator constructions, where the ice bucket 26 is mounted on a door 35 of the refrigerator and is automatically moved whenever the door is opened or closed.

The actuator 30 may comprise a pivotable lever positioned behind the ice bucket 26 such that the first portion 32 or arm of the lever will engage a portion of a rear wall 36 of the ice bucket when the ice bucket is moved into the ice receiving position (FIG. 1), thus moving the actuator into a second, harvesting permitting position. A biasing element 38, such as a spring, is arranged to rotate the actuator 30 to a first, harvest preventing position, to bias the second portion 34 of the actuator into blocking engagement with the ice retention cover 24 to hold the ice retention cover in the first position 32 when the ice bucket 26 is displaced from the ice receiving position (FIG. 2). The actuator 30 may be secured to the ice maker 22 or to a wall of the refrigerator 24. The actuator may also be positioned to the side of the ice bucket 26, to be engaged by a portion of the ice bucket projecting from the side thereof when the ice bucket is located in the ice receiving position. In other embodiments, the actuator may have a configuration different than a lever, such as a movable slide, a rotatable wheel, a cam and wedge, or other known motion transmitting arrangements.

With the ice retention cover 24 blocked, ice will be prevented from being dispensed from the ice maker 24, including that ice that may currently be in the process of being harvested when the ice bucket 26 is displaced from the ice receiving position. This arrangement will prevent ice from being dispensed into a portion of the freezer compartment when the ice bucket 26 is not in place to receive the ice. Such unwanted dispensing could otherwise cause blocking of the proper re-positioning of the ice bucket 26 to occur, requiring the user to remove the entire ice bucket, and perhaps other drawers or food items from the freezer compartment, in order to clear all of the uncollected ice from the freezer compartment.

In an embodiment, an ice height detection system 39 is arranged to detect or sense a height of ice in the ice bucket 26. The ice height detection system 39 may comprise a movable bail arm 40 provided with a portion 42 located between the ice maker 22 and the ice bucket 26, the bail arm being movable between a first position 43 (FIG. 1) and a second position 44 (FIG. 2). The second position 44 of the bail arm 40 is typically located above the bail arm first position 43. A bail arm biasing element 46, which may be a spring, or may be a mass acted upon by gravity, is arranged to bias the bail arm 40 towards the first position 43 from the second position 44. The bail arm 40 is operably connected to the ice maker 22 such that when the bail arm 40 is in the first position 43 and between the first position and the second position 44, the ice maker is enabled to make, harvest and dispense ice. When the bail arm 40 is in the second position 44, the ice maker 22 is disabled from at least one of making, harvesting and dispensing ice. Movement of the actuator 30 from the first position to the second position will cause the bail arm 40 to detect the actuator as an obstacle and to move in response to engagement with the actuator. This lifting arrangement of the bail arm 40 may be included with or in place of the blocking of the ice retention cover 24 to prevent the further making or harvesting of ice by the ice maker 22 when the ice bucket 26 is displaced from the ice receiving location. A third, higher position of the bail arm 40 may be provided, where the bail arm will be detained in that position to prevent operation of the ice maker 22, until the bail arm is manually returned to a position below the second position 44.

Figure 6:
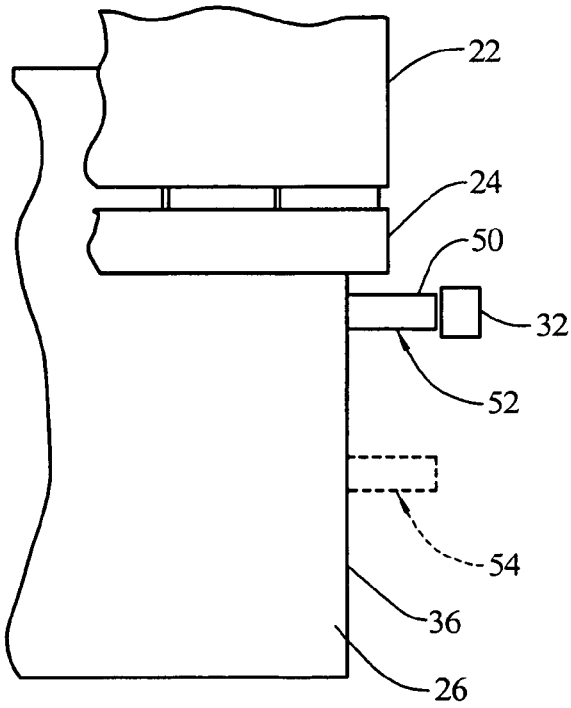
FIG. 6 is a top elevation view of the ice maker and ice harvest prevention mechanism of FIG. 1.

In order to selectively override the return of the actuator 30 to its disengaging position upon the return of the ice bucket 26 to the ice receiving position, a movable actuator engagement button 50 may be carried on the ice bucket as the portion of the rear wall 36 to engage the actuator. The movable actuator engagement button 50 may be arranged so as to engage the first portion 32 of the actuator 30 when the ice bucket 26 is located in the ice receiving position and the button is in a first position 52 (as shown in FIG. 1 and in solid lines in FIG. 6), and to avoid engagement with the first portion of the actuator when the ice bucket is displaced from the ice receiving position (FIG. 2) or when the ice bucket is located in the ice receiving position and the button is in a second position 54 (as in FIG. 3 and in dashed lines in FIG. 6).

Figure 3:
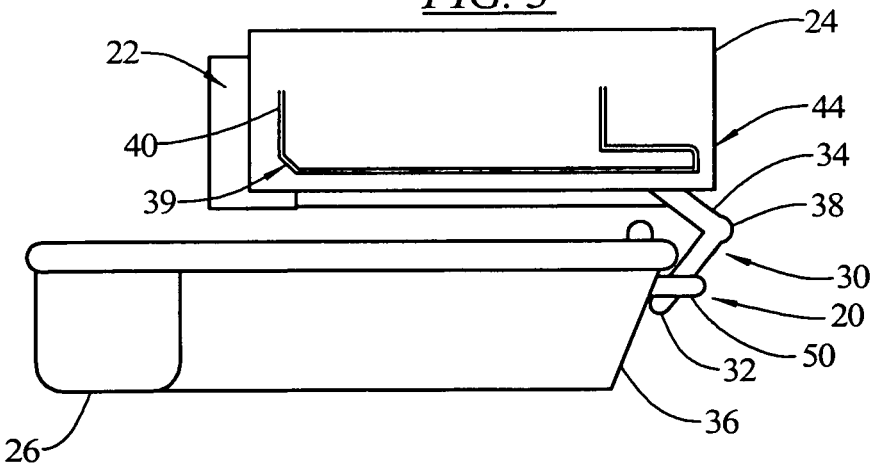
FIG. 3 is a side elevation schematic view of the arrangement of FIG. 1, with the ice bucket in the ice receiving position and the ice harvest prevention mechanism in an enabled position.

When the button 50 is used in an arrangement where the actuator lifts the bail arm 40, the bail arm will be moved into its second position 44 when the ice bucket 26 is displaced from the ice receiving position and when the button 50 is in its second position 54, regardless of a location of the ice bucket. Thus, the bail arm 40 will be retained in its second position 44 to disable at least one of making, harvesting and dispensing ice, even with the ice bucket 26 properly placed in the ice receiving position. This option will allow a user to effectively turn the ice maker off, without having to manually access the bail arm 40. When the button 50 is used in an arrangement where the actuator blocks the ice retention cover 24, the ice retention cover will be retained in its closed, first position, to prevent further dispensing of ice, regardless of a location of the ice bucket 26 (FIGS. 2 and 3).

In an embodiment, the movable actuator button 50 may be carried on the rear wall 36 of the ice bucket 26. The movable actuator button 50 may also be positioned on other portions of the ice bucket 26. In an embodiment, the movable actuator button 50 is arranged to slide between the first position 52 and said second position 54. The button 50 could also be arranged to move in other fashions, such as pivoting or rotating.

In other embodiments, the ice height detection system 39 may comprise a mechanism other than a bail arm, for example, an optical or infrared height detection system, so long as the ice height detection system is operably connected to the ice maker 22 such that when the ice height detection system does not detect any obstacles at a first location 62, such as a certain height in the ice bucket 26, the ice maker is enabled to make, harvest and dispense ice, and when the ice height detection system does detect an obstacle at the first location, the ice maker is disabled from at least one of making, harvesting and dispensing ice. The actuator 30 is located relative to the ice bucket 26 and the ice height detection system 39 such that the second portion 34 of the actuator is able to move into the first location 62 and be detected by the ice height detection system as an obstacle when the ice bucket is displaced from the ice receiving position, or when the button 50 (if present) is in the second position 54, regardless of a location of the ice bucket.

Thus, it has been shown that the invention provides an ice harvesting prevention mechanism 20, including an actuator 30, for an ice maker. The ice maker is arranged to make, harvest and dispense ice to an ice bucket 26 located in an ice receiving position. An ice harvesting prevention device 24, 39 is arranged to prevent dispensing of ice in a first position of the actuator 30 and to permit dispensing of ice in a second position of the actuator. The ice bucket 26 itself, or a movable button 50 carried on the ice bucket, may engage the actuator 30, when the ice bucket is placed in the ice receiving position, to move the actuator from the first position to the second position. The button 50 may be moved to an "off" position 54 to prevent engagement with the actuator 30, thereby preventing dispensing of ice when the ice bucket 26 is in the ice receiving position.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. In other embodiments, different combinations of components than those combinations specifically shown and described could be used. The disclosed embodiments are provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An ice harvesting prevention mechanism comprising:

an ice maker arranged to make, harvest and dispense ice, an ice bucket located in an ice receiving position relative to said ice maker to receive ice dispensed from said ice maker, a prevention device arranged to enable the making, harvesting and dispensing of ice by said ice maker when in a first position and to prevent at least one of the making, harvesting and dispensing of ice by said ice maker when in a second position, an actuator located relative to said ice bucket and said prevention device such that a first portion of said actuator will be in engagement with a movable actuator engagement button carried on said ice bucket when said ice bucket is located in said ice receiving position and a second portion of said actuator is able to move into engagement with said prevention mechanism when said ice bucket is displaced from said ice receiving position, and an actuator biasing element arranged to bias said second portion of said actuator into engagement with said prevention mechanism when said ice bucket is displaced from said ice receiving position and to move said prevention mechanism to said second position, said movable actuator engagement button arranged so as to engage said first portion of said actuator when said ice bucket is located in said ice receiving position and said button is in a first position, and to avoid engagement with said first portion of said actuator when said ice bucket is displaced from said ice receiving position or when said ice bucket is located in said ice receiving position and said button is in a second position, wherein said prevention device will be moved into said second position when said ice bucket is displaced from said ice receiving position and when said button is in said second position, regardless of a location of said ice bucket.

2. An ice harvesting prevention mechanism according to claim 1, wherein said movable actuator button is carried on a rear wall of said ice bucket.

3. An ice harvesting prevention mechanism according to claim 1, wherein said movable actuator button is arranged to slide between said first position and said second position.

4. An ice harvesting prevention mechanism according to claim 1, wherein said actuator comprises a pivotable lever.

5. An ice harvesting prevention mechanism according to claim 1, wherein said actuator biasing element comprises a spring.

6. An ice harvesting prevention mechanism according to claim 1, wherein said prevention device comprises a movable bail arm with a portion located between said ice maker and said ice bucket, said bail arm movable between said first position and said second position, a bail arm biasing element arranged to bias said bail arm towards said first position from said second position, said bail arm being operably connected to said ice maker such that when said bail arm is in said first position and between said first position and said second position, said ice maker is enabled to make, harvest and dispense ice, and when said bail arm is in said second position, said ice maker is disabled from at least one of making, harvesting and dispensing ice, and said second portion of said actuator is movable into a position to move said bail arm into said second position when not engaged by said button.

7. An ice harvesting prevention mechanism according to claim 6, wherein said bail arm biasing element comprises a spring.

8. An ice harvesting prevention mechanism according to claim 1, wherein said prevention device comprises an ice retention cover arranged to prevent dispensing of ice from said ice maker when in a second position and to permit dispensing of ice from said ice maker when in a first position and said second portion of said actuator being movable into a position to block said ice retention cover to prevent it from moving from said second position to said first position when not engaged by said button.

9. An ice harvesting prevention mechanism according to claim 8, wherein said ice retention cover is normally oriented vertically and hangs in said second position, but is pivotable to said first position, unless otherwise blocked, when engaged by ice pieces being dispensed from said ice maker.

10. An ice harvesting prevention mechanism comprising:

an ice maker arranged to make, harvest and dispense ice, an ice bucket located in an ice receiving position relative to said ice maker to receive ice dispensed from said ice maker, an ice retention cover arranged to permit dispensing of ice from said ice maker when in a first position and to prevent dispensing of ice from said ice maker when in a second position, an actuator located relative to said ice bucket and said ice retention cover such that a first portion of said actuator will be in engagement with said ice bucket when said ice bucket is located in said ice receiving position and a second portion of said actuator is able to move into engagement with said ice retention cover when said ice bucket is displaced from said ice receiving position, and a biasing element arranged to bias said second portion of said actuator into blocking engagement with said ice retention cover to hold said ice retention cover in said second position when said ice bucket is displaced from said ice receiving position.

11. An ice harvesting prevention mechanism according to claim 10, including a movable actuator engagement button arranged so as to engage said first portion of said actuator when said ice bucket is located in said ice receiving position and said button is in a first position, and to avoid engagement with said first portion of said actuator when said ice bucket is displaced from said ice receiving position or when said ice bucket is located in said ice receiving position and said button is in a second position, wherein said ice retention cover will be blocked in said first position when said ice bucket is displaced from said ice receiving position and when said button is in said second position, regardless of a location of said ice bucket.

12. An ice harvesting prevention mechanism according to claim 10, including a movable bail arm with a portion located between said ice maker and said ice bucket, said bail arm movable between a first position and a second position, and a bail arm biasing element arranged to bias said bail arm towards said first position from said second position, said bail arm being operably connected to said ice maker such that when said bail arm is in said first position and between said first position and said second position, said ice maker is enabled to make, harvest and dispense ice, and when said bail arm is in said second position, said ice maker is disabled from at least one of making, harvesting and dispensing ice, and said actuator being located relative to said bail arm such that said second portion of said actuator is able to move into engagement with said bail arm when said ice bucket is displaced from said ice receiving position, wherein said bail arm will be moved into said second position when said ice bucket is displaced from said ice receiving position.

13. An ice harvesting prevention mechanism according to claim 10, wherein said biasing element comprises a spring.

14. An ice harvesting prevention mechanism according to claim 10, wherein said actuator comprises a pivotable lever.

15. An ice harvesting prevention mechanism according to claim 10, wherein said ice retention cover is normally oriented vertically and hangs in said second position, but is pivotable to said first position, unless otherwise blocked, when engaged by ice pieces being dispensed from said ice maker.

16. An ice harvesting prevention mechanism comprising:

an ice maker arranged to make, harvest and dispense ice, an ice bucket located in an ice receiving position relative to said ice maker to receive ice dispensed from said ice maker, an ice height detection system arranged to detect a height of ice in said ice bucket, said ice height detection system being operably connected to said ice maker such that when said ice height detection system does not detect any obstacles at a first location, said ice maker is enabled to make, harvest and dispense ice, and when said ice height detection system does detect an obstacle at said first location, said ice maker is disabled from at least one of making, harvesting and dispensing ice, an actuator located relative to said ice bucket and said ice height detection system such that a first portion of said actuator will be in engagement with a movable actuator button on said ice bucket when said ice bucket is located in said ice receiving position and a second portion of said actuator is able to move into said first location and be detected as an obstacle by said ice height detection system when said ice bucket is displaced from said ice receiving position, said movable actuator engagement button arranged so as to engage said first portion of said actuator when said ice bucket is located in said ice receiving position and said button is in a first position, and to avoid engagement with said first portion of said actuator when said ice bucket is displaced from said ice receiving position or when said ice bucket is located in said ice receiving position and said button is in a second position, and a biasing element arranged to bias said second portion of said actuator into said first location when said ice bucket is displaced from said ice receiving position and to move said ice height detction system to said second position, wherein said first portion of said actuator will be moved into said first location position when said ice bucket is displaced from said ice receiving position and when said button is in said second position, regardless of a location of said ice bucket.

17. An ice harvesting prevention mechanism according to claim 16, wherein said ice height detection system includes a pivotable bail arm for engaging ice held in said ice bucket.

18. An ice harvesting prevention mechanism for a refrigerator comprising:

an ice maker in said refrigerator arranged to make, harvest and dispense ice, an ice bucket located in an ice receiving position relative to said ice maker to receive ice dispensed from said ice maker, a movable bail arm with a portion located between said ice maker and said ice bucket, said bail arm movable between a first position and a second position, a spring arranged to bias said bail arm towards said first position from said second position, said bail arm being operably connected to said ice maker such that when said bail arm is in said first position and between said first position and said second position, said ice maker is enabled to make, harvest and dispense ice, and when said bail arm is in said second position, said ice maker is disabled from at least one of making, harvesting and dispensing ice, an ice retention cover arranged to prevent dispensing of ice from said ice maker when in a first position and to permit dispensing of ice from said ice maker when in a second position, a pivotable lever located relative to said ice bucket and said bail arm and ice retention cover such that a first arm of said lever will be in engagement with a movable actuator engagement button carried on said ice bucket when said ice bucket is located in said ice receiving position and a second arm of said actuator is able to move into engagement with said bail arm and said ice retention cover when said ice bucket is displaced from said ice receiving position, and a spring arranged to bias said second portion of said actuator into engagement with said bail arm when said ice bucket is displaced from said ice receiving position and to move said bail arm to said second position, said movable actuator engagement button arranged so as to engage said first arm of said actuator when said ice bucket is located in said ice receiving position and said button is in a first position, and to avoid engagement with said first arm of said actuator when said ice bucket is displaced from said ice receiving position or when said ice bucket is located in said ice receiving position and said button is in a second position, wherein said bail arm will be moved into said second position and said ice retention cover will be held in said first position when said ice bucket is displaced from said ice receiving position and when said button is in said second position, regardless of a location of said ice bucket.

19. A ice harvesting prevention mechanism according to claim 18, wherein said ice bucket is arranged to move from said ice receiving position when a door of said refrigerator is opened.

20. An ice harvesting prevention mechanism according to claim 1, wherein said movable actuator button is arranged to slide between said first position and said second position.

* * * * *